US005402703A

United States Patent [19]

Drotleff

[11] Patent Number: 5,402,703

[45] Date of Patent: Apr. 4, 1995

[54] LINER SYSTEM TO REDUCE SPALL

[75] Inventor: James E. Drotleff, Scotts Valley, Calif.

[73] Assignee: FMC Corporation, Chicago, Ill.

[21] Appl. No.: 167,446

[22] Filed: Dec. 15, 1993

Related U.S. Application Data

[63] Continuation of Ser. No. 947,004, Sep. 17, 1992, abandoned.

[51] Int. Cl.[6] ..... F41H 5/04

[52] U.S. Cl. ..... 89/36.02; 109/84; 428/246; 428/911

[58] Field of Search ..... 89/36.02; 109/80, 82, 109/83, 84; 428/246, 911

[56] References Cited

U.S. PATENT DOCUMENTS

| | | | |
|---|---|---|---|
| 2,738,297 | 3/1956 | Pfistershammer | 89/36.02 |
| 3,771,418 | 11/1973 | Gulbiertz et al. | 109/80 |
| 4,061,815 | 12/1977 | Poole | 48/215 |
| 4,186,648 | 2/1980 | Clausen et al. | 89/36.02 |
| 4,364,300 | 12/1982 | Pagano et al. | 89/36.02 |
| 4,732,803 | 3/1988 | Smith, Jr. | 89/36.02 |
| 4,739,690 | 4/1988 | Moskowitz | 89/36.02 |
| 4,805,260 | 7/1989 | Walker et al. | 89/36.02 |
| 4,879,165 | 11/1989 | Smith | 89/36.02 |
| 4,911,062 | 3/1990 | Heyman | 89/36.02 |
| 4,923,741 | 5/1990 | Kosmo et al. | 428/911 |
| 4,934,245 | 6/1990 | Musante et al. | 89/36.02 |

FOREIGN PATENT DOCUMENTS

| | | | |
|---|---|---|---|
| 307672 | 3/1989 | European Pat. Off. . | |
| 334263 | 9/1989 | European Pat. Off. . | |
| 3241526 | 12/1983 | Germany | 109/84 |
| 1577012 | 10/1980 | United Kingdom | 89/36.02 |
| 2149482 | 6/1985 | United Kingdom | 89/36.02 |
| 9206840 | 4/1992 | WIPO . | |

OTHER PUBLICATIONS

Materials in Design Engineering, Mid-October 1965, vol. 62, No. 5, pp. 16-17, 104-105, 236-237.

Ceramic Industry, Jan. 1975, vol. 104, No. 1, pp. 35, 18, 107.

*Primary Examiner*—Stephen C. Bentley

*Attorney, Agent, or Firm*—Michael Lee; R. C. Kamp

[57] ABSTRACT

The invention provides a three layer liner for armor to reduce spall and the spall angle. The liner provides a high impedance.

The liner is formed by layers of silastic rubber with tungsten powder. Successive layers have a decreasing concentration of tungsten powder, causing the density of the successive layers to decrease. This decreasing density causes the high impedance of the liner. The liner is made by casting a layer of the silastic rubber with the tungsten powder mixed in with a second layer of silastic rubber with a lower density of tungsten powder. The material is then pressed into a sheet. One side of the sheet is wet with silastic rubber and merged with a fabric layer.

5 Claims, 1 Drawing Sheet

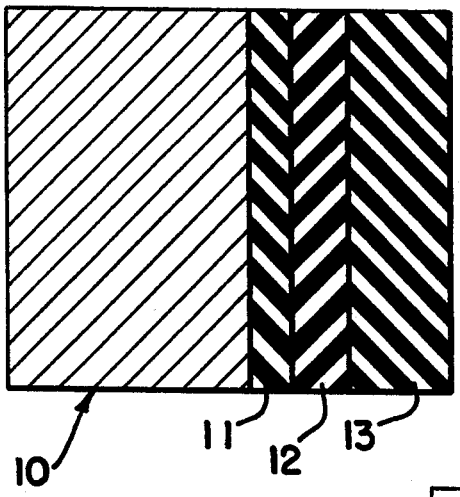
FIG_1
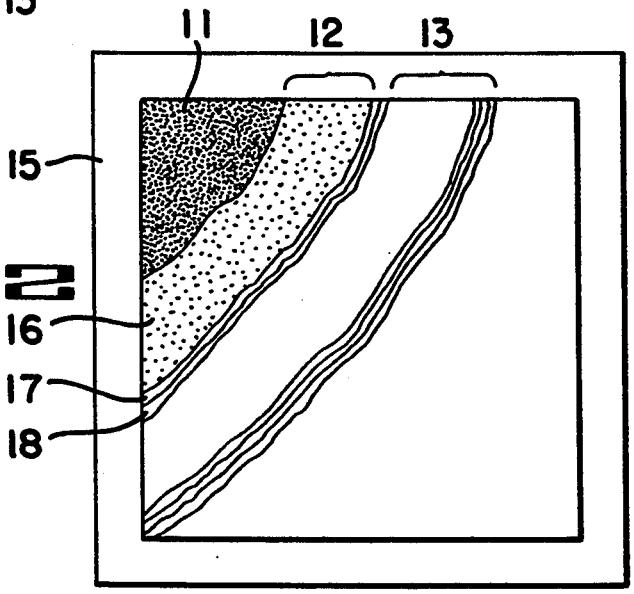
FIG_2
FIG_3
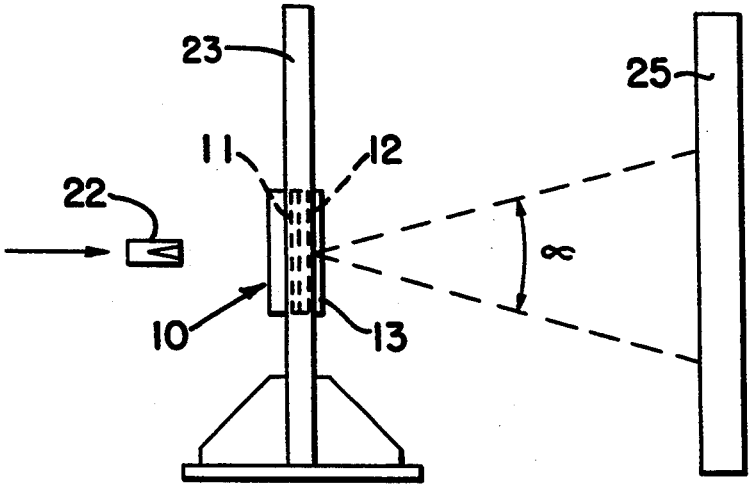

LINER SYSTEM TO REDUCE SPALL

This application is a continuation of application Ser. No. 07/947,004, filed Sep. 17, 1992, now abandoned.

Spall is defined as the tensional failure of an area around a hole created by a projectile or shaped charge jet that has penetrated an armor plate. The penetrating projectile or shaped charge may result in a relatively small amount of damage inside an armored vehicle. The spall created by this penetration however, spreads out in a wide cone angle and can cause severe and lethal damage to soft targets within the vehicle.

The invention provides an improved multilayer liner that reduces the cone angle and the amount of spall created by penetrating projectiles or shaped charged jets.

FIG. 1 is a cross sectional view of pan of an armor system using a preferred embodiment of the inventive spall liner.

FIG. 2 is a cut away view of the inventive spall liner in a frame.

FIG. 3 is a side view of a testing procedure of the inventive spall liner.

FIG. 1 is a cross sectional view of part of an armor layer 10 attached to a preferred embodiment of the inventive system comprising a first layer 11, a second layer 12, and a third layer 13. The first layer 11 comprises a soft and low density material such as silastic rubber, which contains a fine grained filler material of high density such as tungsten powder. The concentration of the tungsten powder in the silastic rubber is of a quantity that provides a nearly matching shock impedance to the armor layer 10 to allow most of the energy to be transferred from the armor layer 10 to the first layer 11. The second layer 12 comprises the soft and low density material with a lower concentration of the filler material and a reinforced high strength fabric such as Spectra TM fabric or Kevlar TM fabric. The second layer 12 provides a nearly matching impedance with the first layer 11, so that most of the energy is transferred from the first layer 11 to the second layer 12. The third layer 13 comprises the soft low density material with little or no filler material and the reinforced high strength fabric. The third layer 13 provides a nearly matching impedance with the second layer 12, so that most of the energy is transferred from the second layer 12 to the third layer 13. A soft material is defined as an elastic or pliable material such as silastic rubber or polyurethane or polyethylene.

An example of the manufacture of a preferred embodiment of the invention comprises first pouring a mixture of silastic rubber and tungsten powder into a mold. The rubber and tungsten powder is then pressed to form a sheet 11 as shown in FIG. 2, which shows a cut away few of the inventive system. The sheet 11 is placed at the bottom of a frame 15. A first wet layer of silastic rubber 16 with a smaller concentration of tungsten powder than the concentration of tungsten powder in the sheet 11 is applied to one side of the sheet 11. A first layer of fabric 17 is placed on the first wet layer of silastic rubber 16. The first layer of fabric 17 is wetted with a second wet layer 18 of silastic rubber with a smaller concentration of tungsten powder than the concentration of tungsten powder in the sheet 11. This process is repeated several times until the second layer 12 is completed. The third layer 13 continues the above described layers, but the wet layers of silastic rubber have little or no tungsten powered. The system is removed frown the frame 15, and an adhesive such as a silastic rubber with a tensile strength higher that the tensile strength of the first layer 11 is used to attach the first layer to the armor 10.

FIG. 3 is a side view of a test to illustrate the spall reduction of the inventive system. In FIG. 3 a shaped charge 22 warhead is directed at the armor layer 10 mounted on a test stand 23. The shaped charge 22 produces a high velocity jet of metal that is able to pierce the armor layer 10. Such a piercing by the jet creates a spall cone angle in excess of 90° in the prior art. The piercing by a jet of an armor layer 10 with the first layer 11, second layer 12, and third layer 13 produces a spall cone angle $\alpha$ of approximately 30°. The particles created by the spall impact a witness sheet 25 located on the side of the armor layer 10 opposite from the shaped charge 22. The pattern impact that the particles from the spall make on the witness board 25 helps to determine the spall cone angle $\alpha$.

A first example for the inventive spall liner for steel armor uses a first layer that is 0.15 inches thick and comprises silastic rubber homogeneously mixed with 30% by volume fine-grained tungsten powder that is cured at 150° Fahrenheit and with 2 tons of pressure. The second layer is 0.30 inches thick and comprises a wetting agent comprised of silastic rubber homogeneously mixed with 15% by volume tungsten powder. This wetting agent is used as an interlayer material between approximately 15 plies of Spectra TM fabric. The third layer is 0.30 inches thick and comprises a wetting agent comprised of silastic rubber alone that is used as an interlayer material between approximately 20 plies of Spectra TM fabric. The overall weight of this example is 12 pounds per square foot.

A second example for the inventive spall liner for aluminum uses a first layer that is 0.25 inches thick that comprises silastic rubber homogeneously mixed with 7% by volume fine-grained tungsten powder that is cured at 150° Fahrenheit and at 2 tons of pressure. The second layer is 0.25 inches thick and consists of a wetting agent comprised of silastic rubber homogeneously mixed with 5% by volume tungsten powder. The wetting agent is used as an interlayer material between approximately 15 plies of Spectra TM fabric. The third layer is 0.25 inches thick and comprises a wetting agent comprised of silastic rubber alone, which is used as an interlayer material between approximately 20 plies of Spectra TM fabric. The over all weight of this example is 7 pounds per square foot.

In both examples, a silastic rubber adhesive is used as the bonding agent to apply the liner to the armor.

While a preferred embodiment of the present invention has been shown and described herein, it will be appreciated that various changes and modifications may be made therein without departing from the spirit of the invention as defined by the scope of the appended claims.

What is claimed is:

1. An apparatus for providing protection, by reducing spall, comprising:

an armor plate with a first side and a second side;

a first layer with a first side and a second side, wherein the first side of the first layer is adjacent to the second side of the armor plate, wherein the first layer, comprises an elastomeric material with a first density and a first tensile strength;

means for adhering the first layer to the armor plate;

means for matching the mechanical impedance of the first layer with the mechanical impedance of the armor plate, wherein the means for matching the mechanical impedance of the first layer with the mechanical impedance of the armor comprises a powder with a second density which is greater than the first density, wherein the powder is uniformly mixed into the elastomeric material of the first layer at a first concentration so that the first layer is nearly impedance matched to the armor plate;

a second layer with a first side and a second side, wherein the first side of the second layer is adjacent to the second side of the first layer, wherein the second layer, comprises the elastomeric material with the first density and the first tensile strength;

means for adhering the second layer to the first layer;

means for matching the mechanical impedance of the second layer with the mechanical impedance of the first layer, wherein the means for matching the mechanical impedance of the second layer with the mechanical impedance of the first layer, comprises the powder uniformly mixed into the elastomeric material of the second layer at a second concentration, which is less than the first concentration, and wherein the second layer, further comprises a fabric, so that the second layer is nearly impedance matched to the first layer;

a third layer with a first side and a second side, wherein the first side of the third layer is adjacent to the second side of the second layer, wherein the third layer, comprises the elastomeric material with the first density and the first tensile strength:

means for adhering the third layer to the second layer; and means for matching the mechanical impedance of the third layer with the mechanical impedance of the second layer.

2. The apparatus, as recited in claim 1, wherein the third layer further comprises a fabric, and has a substantially uniform concentration of the powder, wherein the concentration is substantially zero, so that the third layer is nearly impedance matched to the second layer.

3. The apparatus, as recited in claim 1, wherein the elastic material is a rubber material.

4. The apparatus, as recited in claim 3, wherein the fabric is KEVLAR.

5. The apparatus, as recited in claim 4, wherein the powder is tungsten powder.

* * * * *